US010355364B2

(12) United States Patent
Sonozaki et al.

(10) Patent No.: US 10,355,364 B2
(45) Date of Patent: Jul. 16, 2019

(54) WAVEGUIDE SLOT ANTENNA AND METHOD FOR PRODUCING SAME

(71) Applicant: NTN CORPORATION, Osaka (JP)

(72) Inventors: Tomokazu Sonozaki, Mie (JP); Hiroshi Akai, Mie (JP); Kei Hattori, Mie (JP)

(73) Assignee: NTN CORPORATION, Osaka (JP)

( * ) Notice: Subject to any disclaimer, the term of this patent is extended or adjusted under 35 U.S.C. 154(b) by 0 days.

(21) Appl. No.: 15/754,682

(22) PCT Filed: Aug. 31, 2016

(86) PCT No.: PCT/JP2016/075405
§ 371 (c)(1),
(2) Date: Feb. 23, 2018

(87) PCT Pub. No.: WO2017/047381
PCT Pub. Date: Mar. 23, 2017

(65) Prior Publication Data

US 2018/0254563 A1 Sep. 6, 2018

(30) Foreign Application Priority Data

Sep. 18, 2015 (JP) ..... 2015-185040
Sep. 18, 2015 (JP) ..... 2015-185042

(51) Int. Cl.
*H01Q 21/00* (2006.01)
*H01Q 21/06* (2006.01)
(Continued)

(52) U.S. Cl.
CPC ..... *H01Q 13/18* (2013.01); *H01P 3/12* (2013.01); *H01P 11/002* (2013.01);
(Continued)

(58) Field of Classification Search
CPC ..... H01Q 21/005; H01Q 21/064; H01Q 21/0062; H01Q 13/18
(Continued)

(56) References Cited

U.S. PATENT DOCUMENTS 4,255,752 A 3/1981 Noble et al.
4,329,692 A * 5/1982 Brunner ..... G01S 13/872 343/725
(Continued)

FOREIGN PATENT DOCUMENTS

JP 2004-120044 4/2004
JP 2014-60700 4/2014
WO 2014/203859 12/2014

OTHER PUBLICATIONS

International Search Report dated Nov. 22, 2016 in International (PCT) Application No. PCT/JP2016/075405.
(Continued)

*Primary Examiner* — Lam T Mai
(74) *Attorney, Agent, or Firm* — Wenderoth, Lind & Ponack, L.L.P.

(57) ABSTRACT

A waveguide tube slot antenna (1) includes a waveguide tube (10) that is made of a resin and includes a waveguide (2) extending in a tube axis direction; and a plurality of radiating slots (3) provided in the waveguide tube (10). The waveguide tube (10) includes first and second waveguide tube forming members (11 and 12) each having a traverse section having a shape with an end at each part in an extending direction of the waveguide (2), and is configured to define the waveguide (2) by being coupled to each other. The waveguide tube slot antenna (1) includes metal cores (20) disposed along the tube axis direction, and the metal cores (20) are held by both the waveguide tube forming members (11 and 12).

11 Claims, 11 Drawing Sheets

(51) Int. Cl.
*H01Q 13/18* (2006.01)
*H01P 3/12* (2006.01)
*H01P 11/00* (2006.01)

(52) U.S. Cl.
CPC ..... *H01Q 21/005* (2013.01); *H01Q 21/0062* (2013.01); *H01Q 21/064* (2013.01)

(58) Field of Classification Search
USPC ..... 343/767, 770, 771
See application file for complete search history.

(56) References Cited

U.S. PATENT DOCUMENTS 4,499,474 A * 2/1985 Muhs, Jr. ..... H01Q 1/521 343/771
4,716,415 A * 12/1987 Kelly ..... H01Q 21/0006 343/770
5,289,200 A * 2/1994 Kelly ..... H01Q 13/22 343/767
5,717,410 A * 2/1998 Ohmine ..... H01Q 13/10 343/767
9,685,708 B2 * 6/2017 Sonozaki ..... H01Q 13/10
9,812,785 B2 * 11/2017 Sonozaki ..... H01Q 13/22
2004/0056739 A1 3/2004 Inuzuka et al.
2010/0238085 A1 9/2010 Fuh et al.
2015/0229027 A1 * 8/2015 Sonozaki ..... H01Q 13/10 343/771
2016/0372833 A1 * 12/2016 Sonozaki ..... H01Q 13/22
2018/0048071 A1 2/2018 Sonozaki et al.

OTHER PUBLICATIONS

International Preliminary Report on Patentability and Written Opinion of the International Searching Authority dated Mar. 20, 2018 in International (PCT) Application No. PCT/JP2016/075405.
Extended European Search Report dated Mar. 22, 2019 in corresponding European Patent Application No. 16846252.1.

* cited by examiner

WAVEGUIDE SLOT ANTENNA AND METHOD FOR PRODUCING SAME

TECHNICAL FIELD

The present invention relates to a waveguide tube slot antenna and a method of manufacturing the waveguide tube slot antenna.

BACKGROUND ART

As is well known, in a variety of electrical or electronic devices (systems) having a radio communication function, the waveguide tube slot antenna is used as an antenna for transmitting or receiving a radio wave having a high-frequency bandwidth (for example, radio wave having a millimeter wave band) and a radio wave having a low-frequency bandwidth (for example, radio wave having a centimeter wave band). The radio wave having a millimeter wave band is used, for example, for an on-vehicle radar system, and the radio wave having a centimeter wave band is used, for example, for a satellite broadcasting system using a broadcasting satellite (BS), a communication satellite (CS), or the like, a data transmission system such as a wireless LAN or Bluetooth (trademark), and an electronic toll collection system which is abbreviated to ETC (trademark). The radio wave having a millimeter wave band represents a radio wave having a wavelength of from to 10 mm and a frequency of from 30 GHz to 300 GHz, and the radio wave having a centimeter wave band represents a radio wave having a wavelength of from 10 mm to 100 mm and a frequency of 3 GHz to 30 GEL.

The need has arisen for reducing the cost of the waveguide tube slot antenna so as to promote lower prices for the variety of systems having the radio communication function. Accordingly, the applicant of the present application has proposed a waveguide tube slot antenna made of a resin in Patent Literature 1 described below. More specifically, the applicant has proposed a waveguide tube slot antenna that includes: a waveguide tube that is made of a resin and includes a waveguide extending in a tube axis direction, with a defining surface of the waveguide covered with a conductive coating film; and a plurality of radiating slots provided at predetermined intervals along the tube axis direction of the wave guide, the waveguide tube including a first waveguide tube forming member and a second waveguide tube forming member each having a transverse section having a shape with an end (a cross section orthogonal to the tube axis direction) and being configured to define the waveguide by being coupled to each other.

CITATION LIST

Patent Literature 1: JP 2014-60700 A

SUMMARY OF INVENTION

Technical Problem

Incidentally, particularly in an application for transmitting and receiving radio waves at a low frequency band, the antenna needs to be increased in size (the antenna needs to be lengthened) in the relationship with a wavelength. However, in the waveguide tube slot antenna described in Patent Literature 1, when the size of the antenna is increased, undesirable deformation, such as warpage or bending in the tube axis direction, is liable to occur in the waveguide tube (both or any one of the two waveguide tube forming members) due to a temperature change or other factors. The occurrence of the deformation as described above is liable to cause, for example, the following failures.

The shape accuracy of the waveguide is adversely affected to decrease the efficiency in propagation of the radio waves.

A gap is formed in a coupled part of the two waveguide tube forming members, and the radio waves propagated in the waveguide are liable to leak to the outside through this gap.

Therefore, desired antenna characteristics cannot be exerted.

In view of the actual circumstances described above, it is an object of the present invention to achieve a waveguide tube slot antenna capable of stably exerting desired antenna characteristics.

Solution to Problem

In order to solve the above-mentioned problem, according to a first aspect of the present invention, there is provided a waveguide tube slot antenna, comprising: a waveguide tube that is made of a resin and includes a waveguide extending in a tube axis direction, with a defining surface of the waveguide coated with a conductive coating film; and a plurality of radiating slots provided at predetermined intervals along the tube axis direction of the waveguide tube, the waveguide tube including a first waveguide tube forming member and a second waveguide tube forming member each having a transverse section having a shape with an end at each part in an extending direction of the waveguide, and being configured to define the waveguide by being coupled each other, the waveguide tube slot antenna including a metal core disposed along the tube axis direction, and the metal core being held by both the first waveguide tube forming member and second waveguide tube forming member.

As described above, when the metal core disposed along the tube axis direction (metal core extending in the tube axis direction) is held by both the first waveguide tube forming member and the second waveguide tube forming member, bending rigidity and twisting rigidity of the waveguide tube including the coupled body of the two waveguide tube forming members can be enhanced, and hence deformation (in particular, warpage or bending along the tube axis direction) of the waveguide tube due to a temperature change or other factors is less liable to occur, With this configuration, the likelihood of occurrence of such failures as described above can be reduced as much as possible, and hence a waveguide tube slot antenna capable of stably exerting desired antenna characteristics can be achieved.

At least one of the first waveguide tube forming member acid second waveguide tube forming member may be an injection-molded article of a resin integrally including the metal core (an injection-molded article of a resin with the metal core taken as an insertion component). In this manner, the deformation of at least one of the waveguide tube forming members due to the molding shrinkage thereof can be prevented as much as possible. Thus, a decrease in coupling accuracy between the waveguide tube forming members caused by the deformation due to the molding shrinkage, or some other failures can be prevented as much as possible, thereby being capable of stably obtaining a waveguide tube slot antenna excellent in antenna characteristics.

The metal core includes a coupled body of a first metal core and a second metal core, and the first waveguide tube forming member may include an injection-molded article of a resin (an injection-molded article of a resin with the first metal core taken as an insertion component) integrally including the first metal core, and the second waveguide tube forming member may include an injection-molded article of a resin (an injection-molded article of a resin with the second metal core taken as an insertion component) integrally including the second metal core. In this manner, the deformation of each of the first and second waveguide tube forming members due to the molding shrinkage thereof can be prevented as much as possible, thereby being capable of stably obtaining a waveguide tube slot antenna more excellent in antenna characteristics.

The metal core may be buried in a wall part of the waveguide tube, or may be partially exposed to the outer surface of the waveguide tube.

Both the first waveguide tube forming member and second waveguide tube forming member can have the traverse section having a recessed shape.

In order to solve the above-mentioned problem, according to a second aspect of the present invention, there is provided a waveguide tube slot antenna, comprising: a waveguide tube that includes a waveguide extending in a tube axis direction; and a plurality of radiating slots provided at predetermined intervals along the tube axis direction of the waveguide tube, the waveguide tube including a coupled body of a first waveguide tube forming member and a second waveguide tube forming member each having a traverse section having a shape with an end at each part in an extending direction of the waveguide, the first waveguide tube forming member being formed of a flat metal member having the plurality of radiating slots, the second waveguide tube forming member being formed of a resin member integrally holding the first waveguide tube forming member, and at least a defining surface of the waveguide in the waveguide tube being coated with a continuous conductive coating film.

The waveguide tube slot antenna having the above-mentioned configuration can be manufactured by inserting the first waveguide tube forming member formed of a flat metal member having a plurality of radiating slots to injection-mold the second waveguide tube forming member with a resin so as to obtain the waveguide tube, and then performing a process of forming a conductive coating film on the waveguide tube so that at least the defining surface of the waveguide is coated with the conductive coating film.

As described above, through insertion of the first waveguide tube forming member formed of the flat metal member to injection-mold the second waveguide tube forming member with a resin so as to obtain the waveguide tube, the first waveguide tube forming member can function as a reinforcing member, and hence the waveguide tube which is less liable to be deformed due to a temperature change or other factors can be obtained at low cost while the deformation (in particular, warpage or bending in the tube axis direction) of the second waveguide tube forming member due to the molding shrinkage thereof is prevented as much as possible. Further, the second waveguide tube forming member integrally holds the first waveguide tube forming member, and at least the defining surface of the waveguide in the waveguide tube including the coupled body of the two waveguide tube forming members is coated with a continuous conductive coating film (seamless conductive coating film), and hence such a gap, through which radio waves propagated in the waveguide tube leak to the outside, is effectively prevented from being formed in the coupled part of the two waveguide tube forming members. From the above, it is possible to achieve at low cost a waveguide tube slot antenna capable of stably exerting desired antenna characteristics.

In the configuration of the second aspect of the present invention, the first waveguide tube forming member further has a hole, which is provided on a front side in a radiation direction of radio waves radiated to the outside through the radiating slot, and on an inner periphery of which the radiating slot is disposed. Through formation of such a hole in advance, it is possible to eliminate extraneous emission referred to also as grating lobes, thereby being capable of enhancing the antenna characteristics of the waveguide tube slot antenna.

In this case, the first waveguide tube forming member can include a laminate of a first metal plate having the radiating slot and a second metal plate having the hole. In this manner, each of the first metal plate having the radiating slot and the second metal plate having the hole can be taken as a press molded article which is obtained by performing pressing (punching) on the metal plate, so that the first waveguide tube forming member having the radiating slot and the hole can be manufactured at low cost.

The conductive coating film can also be formed continuously along the outer surface of the waveguide tube. Such a conductive coating film (waveguide tube) can be obtained by performing a processing for forming a conductive coating film on the waveguide tube without performing masking processing. This enables omission of a mask forming process on the waveguide tube, which is advantageous in reducing the cost of the waveguide tube slot antenna.

Advantageous Effects of Invention

As described above, according to the first and second aspects of the present invention, it is possible to achieve the waveguide tube slot antenna capable of stably exerting desired antenna characteristics.

DESCRIPTION OF EMBODIMENTS

Now embodiments of the present invention are described with reference to the drawings.

Figure 1A:
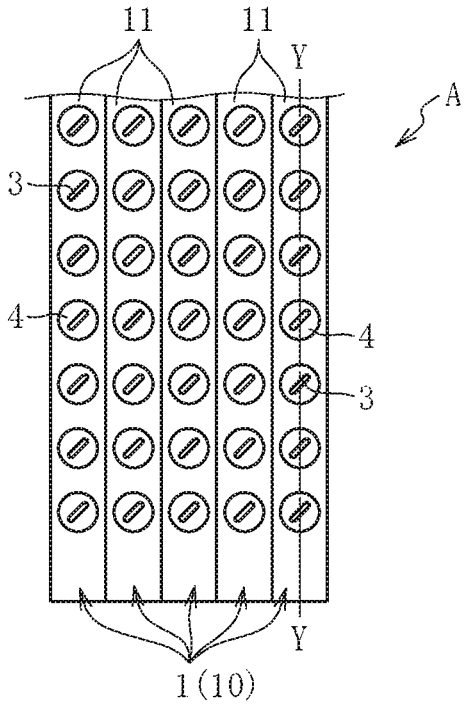
FIG. 1A is a schematic plan view of an antenna unit comprising a waveguide tube slot antenna.
Figure 1B:
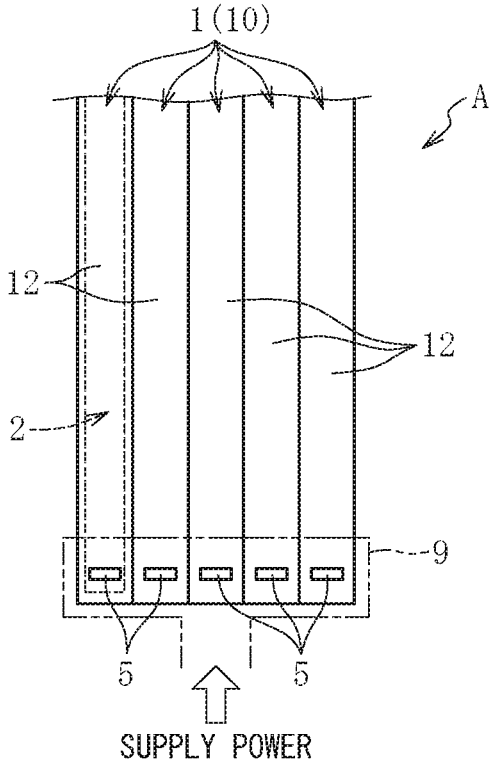
FIG. 1B is a back view of the antenna unit.

FIG. 1A and FIG. 1B are illustrations of a schematic plan view and a schematic hack view of an antenna unit A comprising waveguide tube slot antennas 1, respectively. The antenna unit A is used to transmit or receive a radio wave having a centimeter wave band, and comprises a plurality of (five in the example of FIG. 1A and FIG. 1B) waveguide tube slot antennas 1 connected in parallel with each other and a power supply waveguide tube 9 (indicated by the chain dobble-dashed line in FIG. 1B) configured to supply high-frequency power (radio wave) to each of the waveguide tube slot antennas 1. There are no special limitations on means for connecting the waveguide tube slot antennas 1 in parallel with each other, and, for example, fixation means such as adhesion, fixation with the double coated tape, or the depression and projection fitting is used singly or in combination of two or more kinds thereof. Of the five waveguide tube slot antennas 1, for example, the antenna 1 located in a central part may function as an antenna for transmission of the radio wave, and the two antennas 1 arranged on each side of the antenna 1 may function as an antenna for reception of the radio wave. When this antenna unit A is used in an application for transmitting and receiving radio waves at 24 GHz band, the size of the waveguide tube slot antenna 1 is set so as to have, for example, a dimension of 100 mm in a tube axis direction (up-and-down direction in the drawing sheet of FIG. 1A), a dimension of 20 mm in a width direction (right-and-left direction in the drawing sheet of FIG. 1A), and a dimension of 5 mm in a height direction (direction orthogonal to the drawing sheet of FIG. 1A).

Figure 2A:
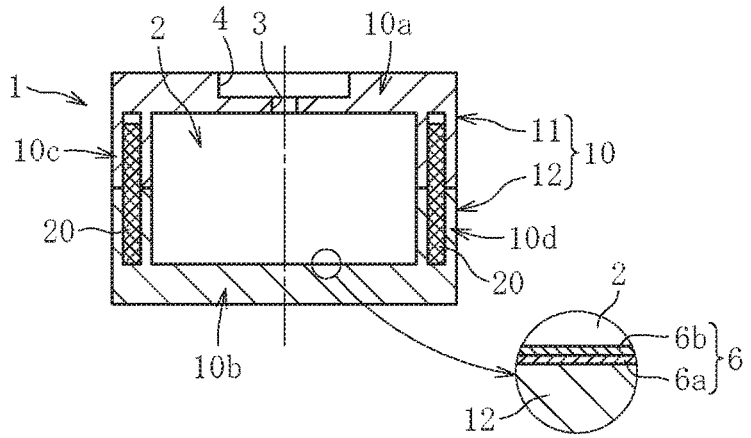
FIG. 2A is a schematic transverse sectional view of a waveguide tube slot antenna according to a first embodiment of a first aspect of the present invention.
Figure 2B:
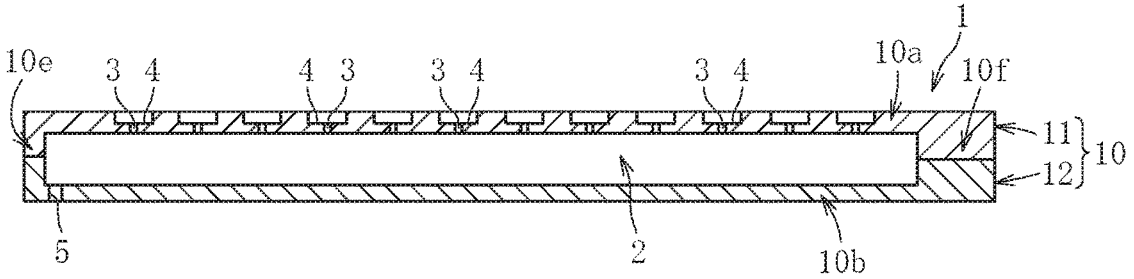
FIG. 2B is a schematic sectional view taken along the line Y-Y of FIG. 1A.

Next, a detailed structure of each waveguide tube slot antenna 1 is described. As also illustrated in FIG. 2A and FIG. 2B, the waveguide tube slot antenna 1 comprises a wave guide tube 10, a plurality of radiating slots 3, and a power supply slot 5. The waveguide tube 10 includes a waveguide 2 inside, which extends in the tube axis direction. The plurality of radiating slots 3 are provided at predetermined intervals along the tube axis direction of the waveguide tube 10. The power supply slot 5 is provided at one end of the waveguide tube 10 in the tube axis direction and is configured to supply high-frequency power to the waveguide 2. As illustrated in FIG. 1A, the radiating slot 3 in this embodiment is provided such that a straight line extending through a center thereof in the width direction is inclined with respect to the tube axis direction by 45 degrees, but the inclination angle of the radiating slot 3 with respect to the tube axis direction can be appropriately set in accordance with the application or the like.

As illustrated in FIG. 2A and FIG. 2B, the waveguide tube 10 is a rectangular waveguide tube having a transverse section having a rectangular shape at each part in the extending direction of the waveguide 2. More specifically, the waveguide tube 10 comprises a top wall 11*a* and a bottom wall 10*b* which are parallel to each other, and side walls 10*c* and 10*d* which are parallel to each other, and further comprises termination walls 10*e* and 10*f* which close openings on one end and another end in the tube axis direction. The plurality of radiating slots 3 are provided on the top wall 10*a*, and the power supply slot 5 is provided on the bottom wall 10*b*. In this embodiment, the dimension of each of the top wall 10*a* and the bottom wall 10*b* in transverse section is longer than the dimension of each of the side walls 10*c* and 10*d* in transverse section. In the following, the side on which the top wall 10*a* is provided is referred to as the upper side, and the side on which the bottom wall 10*b* is provided is referred to as the lower side for convenience of description. However, this does not limit the usage form of the waveguide tube slot antenna 1.

The top wall 10*a* comprises a plurality of recess parts 4 opened in an outer surface of the top wall 10*a* along the tube axis direction, and one radiating slot 3 is opened in an inner bottom surface of each recess part 4. In this embodiment, the recess part 4 is formed so as to have a perfect circle shape in plan view, but the recess part 4 may be formed so as to have a rectangle shape, an ellipse shape, or the like in plan view. Through formation of such recess parts 4, it is possible to suppress extraneous emission referred to also as grating lobes.

The waveguide tube 10 is formed by coupling a first waveguide tube forming member 11 and a second waveguide tube forming member 12 to each other whose transverse sections in each part of the waveguide 2 in the extending direction thereof each have a shape with an end. Specifically, as illustrated in FIG. 2A, the first waveguide tube forming member 11, which integrally has the top wall 10*a* provided with the radiating slots 3 and a part (the upper portion) of each of the side walls 10*c* and 10*d*, and the termination walls 10*e* and 10*f* is coupled to the second waveguide tube forming member 12, which integrally has the bottom wall 10*b* provided with the power supply slot 5 and the remaining part (the lower portion) of each of the side walls 10*c* and 10*d*, and the termination walls 10*e* and 10*f*, to form the waveguide tube 10. In short, the waveguide tube 10 of this embodiment is formed by coupling the first waveguide tube forming member 11 that has a recessed shape with an opened lower side in transverse section to the second waveguide tube forming member 12 that has a recessed shape with an opened upper side in transverse section.

The first waveguide tube forming member 11 is an injection-molded article of a resin, and the radiating slot 3 and the recess part 4 are formed by molding simultaneously with the injection molding. Further, the second waveguide tube forming member 12 is also an injection-molded article of a resin, and the power supply slot 5 is formed by molding simultaneously with the injection molding. As a molding resin for the waveguide tube forming members 11 and 12, a resin having, for example, at least one kind of thermoplastic resin selected from the group consisting of a liquid crystal polymer (LCP), a polyphenylene sulfide (PPS), and a polyacetal (POM) as a base resin thereof is used. One or a plurality of types of fillers such as glass fibers (GF) or carbon fibers (CF) is added to the base resin as necessary. Among the resins exemplified above, the LCP is preferred because the LCP is excellent in form stability compared to a PPS or the like and may preferably suppress an occurrence amount of burrs caused by the molding.

The surface of the first waveguide tube forming member 11 which defines the waveguide 2 and the surface of the second waveguide tube forming member 12 which defines the waveguide 2 are covered with a conductive coating film 6 illustrated in an enlarged view in FIG. 2A. This enables smooth propagation of radio waves along the waveguide 2. The conductive coating film 6 may be formed on entire surfaces of the two waveguide tube forming members 11 and 12. With this configuration, masking formation work before the formation of the conductive coating film 6 and masking removal work after the formation of the conductive coating film 6 are unnecessary, which may suppress cost for coating film formation, and may further suppress manufacturing cost of the waveguide tube slot antenna 1.

The conductive coating film 6 may be formed of a single-layer metal plated coating film, but in this embodiment, the conductive coating film 6 is formed of a first coating film 6*a* obtained by precipitation formation on the surfaces of the waveguide tube forming members 11 and 12 and a second coating film 6*b* obtained by precipitation formation on the first coating film 6*a*. The first coating film 6*a* may be a plated coating film of a metal that is particularly excellent in conductivity (propagation property of the radio wave) such as copper, silver, or gold. Further, the second coating film 6*b* may be a plated coating film of a metal that is excellent in resistance (corrosion resistance) such as nickel. With the conductive coating film 6 having such a stacked structure, the conductive coating film 6 may have high conductivity and high resistance simultaneously, and in addition, a usage amount of an expensive metal such as copper and silver may be suppressed to obtain the conductive coating film 6 at low cost.

The conductive coating film 6 (6*a* and 6*b*) can be formed by, for example, an electrolytic plating method or an electroless plating method, but the electroless plating method is preferred. This is because the electroless plating method is more likely to obtain the conductive coating film 6 (6*a* and 6*b*) having a uniform thickness than the electrolytic plating method, which is advantageous in ensuring desired antenna performance. The film thickness of the conductive coating film 6 becomes lower in resistance when being too thin, and when being too thick to the contrary, requires an excessive amount of time for coating film formation, which leads to increased cost. From such a viewpoint, it is preferred that the film thickness of the conductive coating film 6 be set to 0.2 μm or more and 1.5 μm or less. When the conductive coating film 6 has a laminate structure of the first coating film 6*a* and the second coating film 6*b* as in this embodiment, the respective film thicknesses of the first coating film 6*a* and the second coating film 6*b* can be set to about 0.1 μm to about 1.0 μm and about 0.1 μm to 0.5 μm, for example.

Figure 3A:
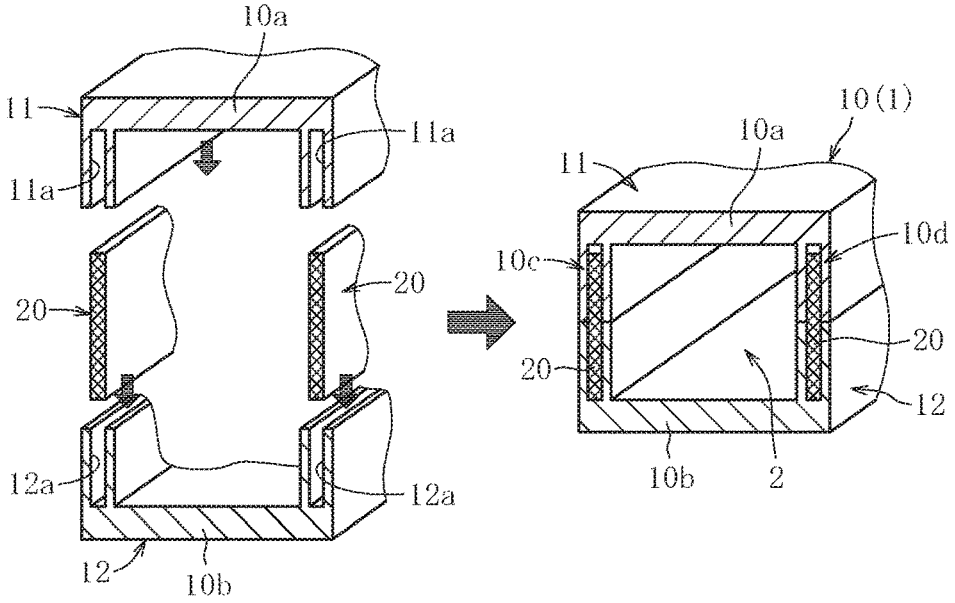
FIG. 3A is a schematic perspective view for illustrating one example of a method of assembling the waveguide tube slot antenna illustrated in FIG. 2.

The waveguide tube 10 is disposed along the tube axis direction and further includes metal cores 20 that are held by both the first waveguide tube forming member 11 and the second waveguide tube forming member 12. As also illustrated in FIG. 3A, the metal cores 20 are formed of a plate-like member having a rectangular shape extending in the tube axis direction, and are buried in an upright posture inside the side walls 10*c* and 10*d*, respectively. That is, in this embodiment, a pair of metal cores 20 and 20 is not exposed on any of the inner surface (waveguide 2) and the outer surface of the waveguide tube 10. As the metal core 20, it is possible to adopt a metal plate of stainless steel, brass, aluminum (aluminum alloy), or a plate-like member made of a sintered metal mainly composed of iron or copper. It is particularly preferred to adopt a brass plate or an aluminum plate, which is excellent in conductivity, as the metal core 20 so as to further enhance the propagation properties of radio waves propagated in the waveguide 2.

The pair of metal cores 20 and 20 can be held by both the first waveguide tube forming member 11 and the second waveguide tube forming member 12 by, for example, adopting any of means (procedures) described in (1) to (3) below.

(1) The upper portions of the metal cores 20 and 20 are fitted into holders 11*a* provided in (portions constructing the side walls 10*c* and 10*d* of) the first waveguide tube forming member 11, and the lower portions of the metal cores 20 and 20 are fitted into holders 12*a* provided in (portions constructing the side walls 10*c* and 10*d* of) the second waveguide tube forming member 12 (see FIG. 3A).

Figure 3B:
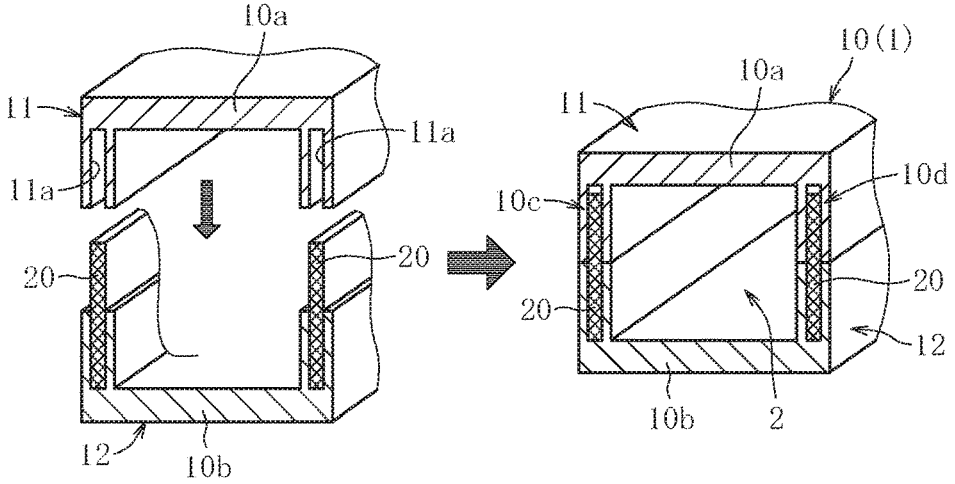
FIG. 3B is a schematic perspective view for illustrating another example of the method of assembling the waveguide tube slot antenna.

(2) In order to integrally hold the lower portions of the metal cores 20 and 20 by the second waveguide tube forming member 12, the second waveguide tube forming member 12 is injection-molded with resin by taking the metal cores 20 and 20 as insertion components, and the upper portions (portions protruding from the second waveguide tube forming member 12) of the metal cores 20 and 20 are fitted into the holders 11*a* respectively provided in portions constructing the side walls 10*c* and 10*d* of the first waveguide tube forming member 11 (see FIG. 3B).

Figure 3C:
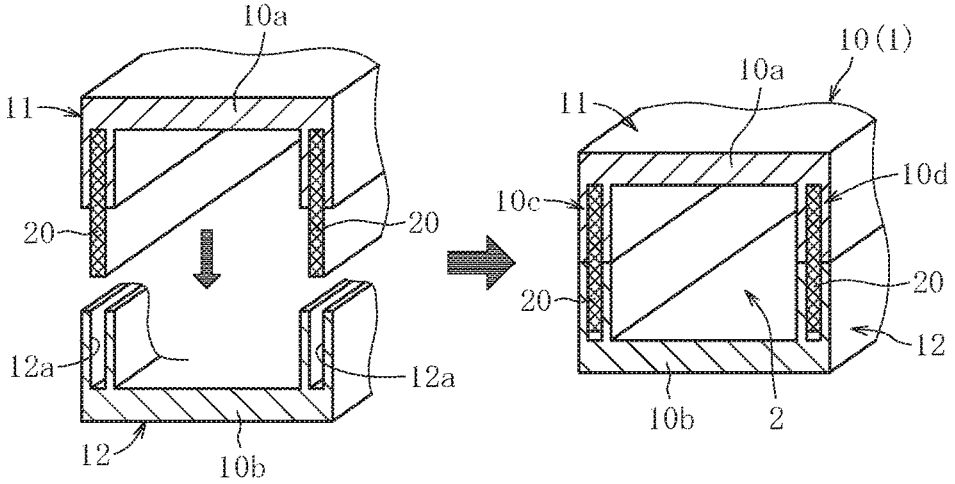
FIG. 3C is a schematic perspective view for illustrating another example of the method of assembling the waveguide tube slot antenna.

(3) In order to integrally hold the upper portions of the metal cores 20 and 20 by the first waveguide tube forming member 11, the first waveguide tube forming member 11 is injection-molded with resin by taking the metal cores 20 and 20 as insertion components, and the lower portions (portions protruding from the first waveguide tube forming member 11) of the metal cores 20 and 20 are fitted into the holders 12*a* respectively provided in portions constructing the side walls 10*c* and 10*d* of the second waveguide tube forming member 12 (see FIG. 3C).

In this embodiment, the means of (2) described above is adopted to hold the pair of metal cores 20 and 20 by the two waveguide tube forming members 11 and 12. In the case of adopting the means of (2) described above, when the vertical dimension of the holder 11*a* provided in the first waveguide tube forming member 11 is smaller than the vertical dimension of the upper portion of the metal core 20 to be held by this holder 11*a*, the opposed two surfaces of the first waveguide tube forming member 11 and the second waveguide tube forming member 12 cannot be brought into contact with each other (a gap is formed between the two waveguide tube forming members 11 and 12), which may adversely affect the antenna characteristics. Thus, the vertical dimension of the holder 11*a* is previously set slightly larger than the vertical dimension of the upper portion of the metal core 20 to be held by this holder 11*a*, Also in the case of adopting the means (1) or (3) described above, the vertical dimensions of the holders 11*a* and 12*a* are set for the similar reason.

From the above, the waveguide tube slot antenna 1 (waveguide tube 10) according to this embodiment is completed by: injection-molding the first waveguide tube forming member 11 with resin, while injection-molding the second waveguide tube forming member 12 with resin by taking the metal cores 20 and 20 as insertion components forming the conductive coating film 6 on the surfaces of the two waveguide tube forming members 11 and 12 which define the waveguide 2, and then coupling the two waveguide tube forming members 11 and 12 to each other. The method of coupling the first waveguide tube forming member 11 and the second waveguide tube forming member 12 to each other can be suitably selected, and it is possible to adopt, for example, adhesion performed by curing an adhesive applied to an abutting part of the two waveguide tube forming members 11 and 12, welding performed by welding the waveguide tube forming members 11 and 12 to each other on the abutting part of the two waveguide tube forming members 11 and 12, or some other methods. Besides these methods, through fitting (press-fitting) of a protrusion provided on one of the two waveguide tube forming members 11 and 12 into a recess provided on another thereof the two waveguide tube forming members 11 and 12 can be coupled to each other. Further, the two waveguide tube forming members 11 and 12 can also be coupled to each other by using the metal core 20. Specifically, it is possible to adopt, for example, a method of press-fitting (fitting in an interference state) the upper portion of the metal core 20 into the holder 11*a* provided in the first waveguide tube forming member 11, a method of fitting the upper portion of the metal core 20 into the holder 11*a* filled with an adhesive and then curing the adhesive, or some other methods.

When adhesion is used for coupling both the waveguide tube forming members 11 and 12 to each other, for example, a thermosetting adhesive, an ultraviolet-curable adhesive, or an anaerobic adhesive may be used as an adhesive therefor, but with the thermosetting adhesive that requires heat processing when the adhesive is cured, the waveguide tube forming members 11 and 12 made of a resin may be, for example, deformed while being subjected to the heat processing. Therefore, the ultraviolet-curable adhesive or the anaerobic adhesive is preferred as the adhesive. The adhesive is generally an isolator, and hence when the adhesive adheres to a defining surface of the waveguide 2, there is a fear that a propagation property of the radio wave may be adversely affected. Therefore, when the adhesion is used for coupling both the waveguide tube forming members 11 and 12 to each other, it is important to pay attention so as to prevent the adhesive from adhering to the defining surface of the waveguide 2.

In the waveguide tube slot antenna 1 described above, the metal cores 20 disposed along the tube axis direction are held by bath the first and second waveguide tube forming members 11 and 12. This enhances the bending rigidity and the twisting rigidity of the waveguide tube 10 so that, even when both or any one of the two waveguide tube forming members 11 and 12 are to be deformed due to a temperature change or other factors, the deformation can be controlled by the metal core 20. This can reduce as much as possible the likelihood of occurrence of such failures as that the shape accuracy of the waveguide 2 decreases caused by the deformation of the waveguide tube forming members 11 and 12, and that a gap is formed in the coupled part of the two waveguide tube forming member 11 and 12 and radio waves propagated in the waveguide 2 leak to the outside through this gap. Thus, it is possible to achieve at low cost the waveguide tube slot antenna 1 capable of stably exerting desired antenna characteristics.

Particularly in this embodiment, the second waveguide tube forming member 12 is the injection-molded article of a resin integrally including the metal core 20 (the resin injection-molded article with the metal core 20 taken as the insertion component), so that the deformation of the second waveguide tube forming member 12 due to the molding shrinkage thereof can be prevented as much as possible. Thus, a decrease in coupling accuracy between the waveguide tube forming members 11 and 12 caused by the deformation of the second waveguide tube forming member 12 due to the molding shrinkage thereof, or some other failures, can be prevented as much as possible, thereby being capable of stably mass-producing the waveguide tube slot antenna 1 excellent in antenna characteristics.

The waveguide tube slot antenna 1 according to the first embodiment of the first aspect of the present invention is described above, but appropriate changes can be made to the waveguide tube slot antenna 1. Now, other embodiments are described below with reference to the drawings, but the components equivalent to those of the first embodiment described above are denoted by common reference symbols, and duplicate descriptions thereof are omitted as much as possible.

Figure 4A:
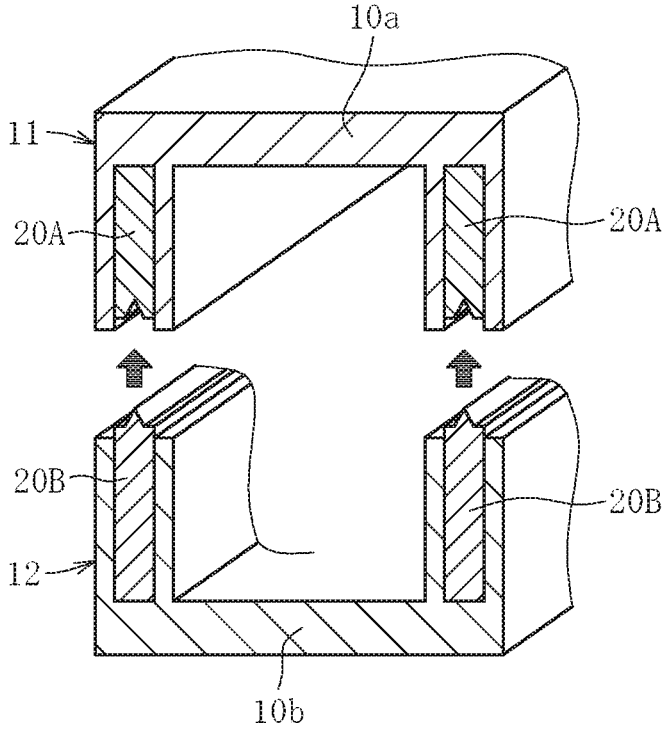
FIG. 4A is a schematic perspective view of a state before assembly of a waveguide tube slot antenna according to a second embodiment of the first aspect of the present invention.
Figure 4B:
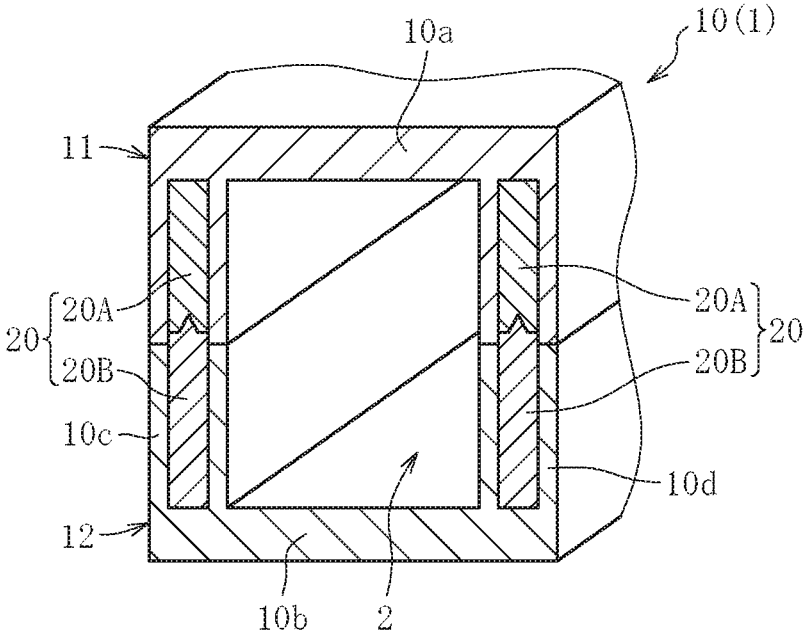
FIG. 4B is a schematic perspective view of the waveguide tube slot antenna according to the second embodiment of the first aspect.

In each of FIG. 4A and FIG. 4B, there is illustrated a schematic perspective view (a schematic perspective view including a cross section) of the waveguide tube slot antenna 1 according to a second embodiment of the first aspect of the present invention. The waveguide tube slot antenna 1 illustrated in each of these drawings is different from the waveguide tube slot antenna 1 described above mainly in that the metal cores 20 respectively buried in the side walls 10*c* and 10*d* of the waveguide tube 10 each including a coupled body of the first metal core 20A and the second metal core 203, the first waveguide tube forming member 11 includes an injection-molded article of a resin integrally including the first metal core 20A (an injection-molded article of a resin with the first metal core 20A taken as an insertion component), and the second waveguide tube forming member 12 includes an injection-molded article of a resin integrally including the second metal core 203 (an injection-molded article of a resin with the second metal core 20B taken as an insertion component).

In this manner, the deformation of each of the first and second waveguide tube forming members 11 and 12 due to the molding shrinkage thereof can be prevented as much as possible, thereby being capable of further enhancing the coupling accuracy between the two waveguide tube forming members 11 and 12. Thus, it is possible to achieve the waveguide tube slot antenna 1 with more excellent antenna characteristics. In this embodiment, as illustrated in FIG. 4A and FIG. 4B, a protrusion provided on (the upper end of) a second metal core 203 is press-fitted into a recess provided on (the lower end of) a first metal core 20A, thereby being capable of achieving the metal core 20 including a coupled body of the two metal cores 20A and 20B. Besides the press-fitting described above, for example, by adhesion, the use of both the press-fitting and adhesion, or some other means, the two metal cores 20A and 203 can be coupled to each other. In addition, the two waveguide tube forming members 11 and 12 can be coupled to each other by a suitably selected method.

Figure 5A:
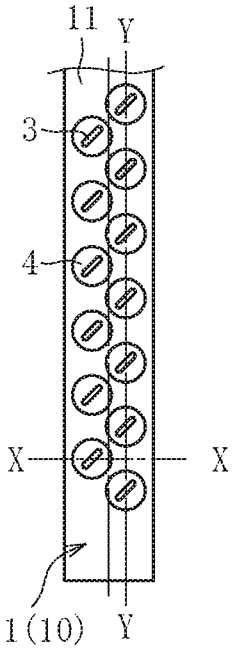
FIG. 5A is a partial plan view of a waveguide tube slot antenna according to a third embodiment of the first aspect of the present invention.
Figure 5B:
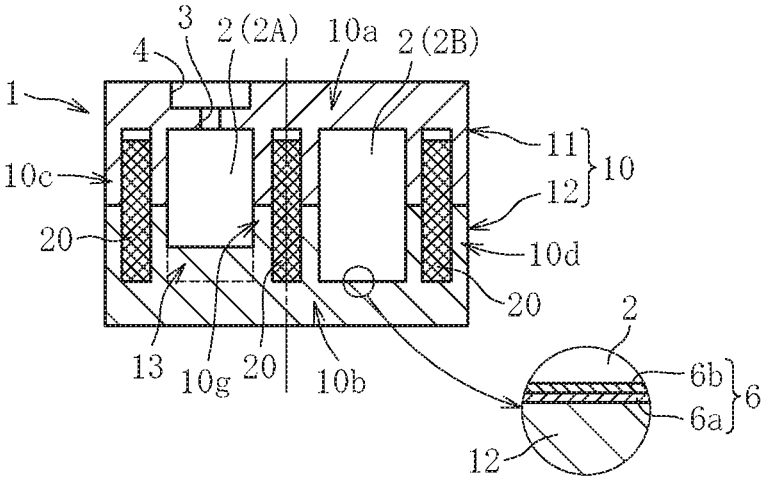
FIG. 5B is a schematic sectional view taken along the line X-X of FIG. 5A.
Figure 5C:
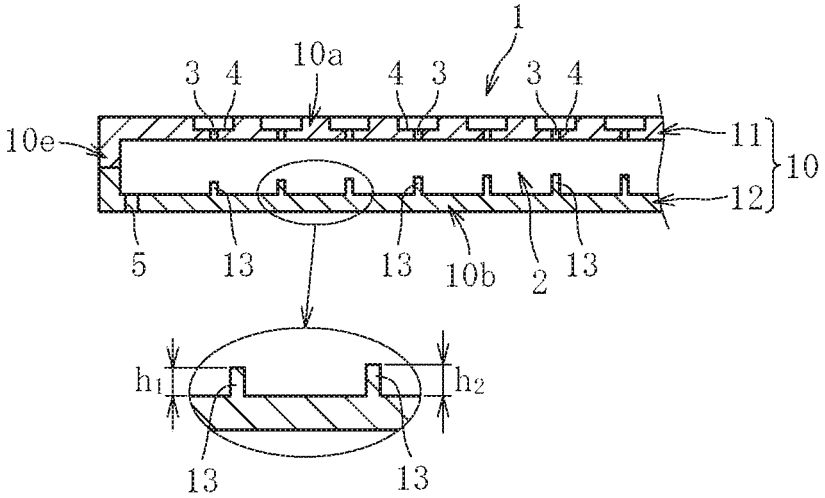
FIG. 5C is a schematic sectional view taken along the line Y-Y of FIG. 5A.

FIG. 5A to FIG. 5C are schematic illustrations of a partial plan view, a transverse sectional view, and a longitudinal sectional view of a waveguide tube slot antenna 1 according to a third embodiment of the first aspect of the present invention, respectively. In the waveguide tube slot antenna 1 according to this embodiment, as illustrated in FIG. 5A, two radiating slot rows each obtained by arranging the plurality of radiating slots 3 along the tube axis direction at predetermined intervals are provided in the width direction of the waveguide tube 10, and at the same time, the radiating slot 3 forming one of the radiating slot rows and the radiating slot 3 forming another radiating slot row are located at mutually different positions in the tube axis direction. To briefly describe, in the waveguide tube slot antenna 1 according to this embodiment, the plurality of radiating slots 3 and recess parts 4 are arranged in a staggered shape.

As illustrated in FIG. 5B and FIG. 5C, the waveguide tube slot antenna 1 (waveguide tube 10) according to this embodiment further comprises: a branching wall 10*g* arranged in parallel with the side walls 10*c* and 10*d* and configured to branch the waveguide 2 into two waveguides 2A and 2B, and a plurality of inner walls 13 configured to reduce a cross sectional area of the waveguides 2 (2A and 2B) at formation positions of the radiating slots 3. The inner wall 13 is erected on an inner bottom surface of the bottom wall 10*b*, and is formed so that two inner walls 13 and 13 adjacent to each other in the tube axis direction satisfy a relational expression of $h_1 \leq h_2$, where $h_1$ represents a height dimension of the inner wall 13 on a side relatively close to the power supply slot S and $h_2$ represents a height dimension of the inner wall 13 on a side relatively far from the power supply slot S (see the enlarged view in FIG. 5C). One radiating slot row is formed along the waveguide 2A, and another radiating slot row is formed along the waveguide 2B.

As described above, when the inner wall 13 for reducing the cross sectional area of the waveguide 2 is provided in the formation position for the radiating slot 3 in advance, it is possible to enhance radiation efficiency of radio waves propagated in the waveguide 2. In particular, assuming that, of two inner walls 13 and 13 adjacent in the tube axis direction, $h_1$ represents the height dimension of the inner wall 13 on a side relatively close to the power supply slot 5, and $h_2$ represents the height dimension of the inner wall 13 on a side relatively far from the power supply slot 5, when a relational expression of $h_1 \leq h_2$ is satisfied, an amount of radio waves radiated to the outside of the antenna 1 through each radiating slot 3 is less liable to vary among the radiating slots 3, so that radio waves in almost equal amount can be radiated from each radiating slot 3. Thus, the occurrence of variations in antenna performance among the parts in the tube axis direction can be avoided as much as possible, thereby improving the reliability of the waveguide tube slot antenna 1.

The waveguide tube 10 that forms the waveguide tube slot antenna 1 according to this embodiment is also formed by coupling the first waveguide tube forming member 11 and the second waveguide tube forming member 12 made of the resin to each other whose transverse sections each have a shape with an end in each part of the waveguide 2 in the extending direction thereof and in which at least the defining surface of the waveguide 2 is coated with the conductive coating film 6. Specifically, the first waveguide tube forming member 11, which integrally has the top wall 10*a* provided with the radiating slots 3 and the recess parts 4 and a part (the upper portion) of each of the side walls 10*c* and 10*d*, the termination walls 10*e* and 10*f*, and the branching wall 10*g*, is coupled to the second waveguide tube forming member 12, which integrally has the bottom wall 10*b* provided with the power supply slot 5 and the remaining part (the lower portion) of each of the side walls 10*c* and 10*d*, the termination walls 10*e* and 10*f*, and the branching wall 10*g*, thereby forming the waveguide tube 10.

The waveguide tube slot antenna 1 of the third embodiment is also disposed along the tube axis direction and further includes metal cores 20 that are held by both the first and second waveguide tube forming members 11 and 12. The metal cores 20 are each formed of a plate-like member having a rectangular shape extending in the tube axis direction, and are buried in an upright posture inside the side walls 10*c* and 10*d*, and a branching wall 10*g*. With the metal cores 20 provided in the above-mentioned form, the waveguide tube slot antenna 1 of this embodiment can also obtain a similar effect to that of the waveguide tube slot antenna 1 illustrated in FIG. 2 or other drawings.

Although a detailed illustration is omitted, in this embodiment, in order to integrally hold all of the three metal cores 20 by any one of the two waveguide tube forming members 11 and 12, the first waveguide tube forming member 11 or the second waveguide tube forming member 12 can be injection-molded with resin by taking the three metal cores 20 as insertion components. Besides that, any one of the two waveguide tube forming members 11 and 12 can be injection-molded with resin by taking the metal cores 20 and 20, respectively held by the side walls 10*c* and 10*d*, as insertion components while another of the two waveguide tube forming members 11 and 12 is injection-molded with resin by taking the metal core 20, which is held by the branching wall 10*g*, as an insertion component.

Figure 6A:
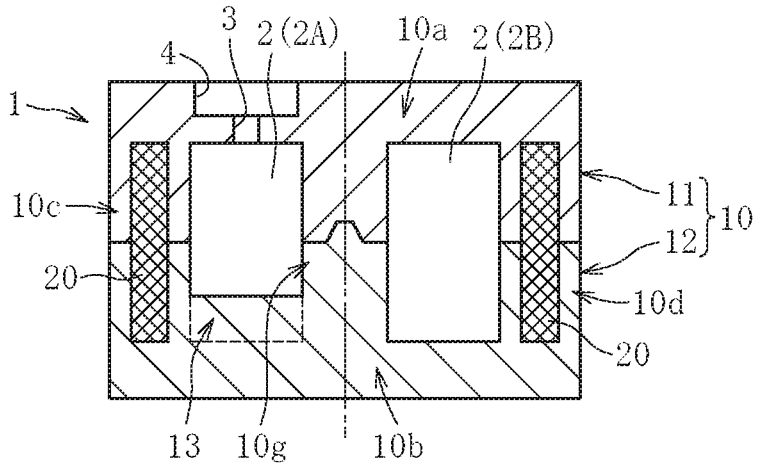
FIG. 6A is a schematic transverse sectional view of a waveguide tube slot antenna according to a fourth embodiment of the first aspect of the present invention.

FIG. 6A is a schematic transverse sectional view of a waveguide tube slot antenna A according to a fourth embodiment of the first aspect of the present invention. The waveguide tube slot antenna 1 illustrated in FIG. 6A is a modification example of the waveguide tube slot antenna 1 illustrated in FIG. 5A to FIG. 5C, and the branching wall log is formed only of the first and second waveguide tube forming members 11 and 12. That is, the branching wall 10*g* does not hold the metal core 20. In FIG. 6A, the branching wall 10*g* is formed by fitting (press-fitting) a protrusion, which is provided in a portion of the second waveguide tube forming member 12 which forms the branching wall 10*g*, into a recess, which is provided in a portion of the first waveguide tube forming member 11 which forms the branching wall 10*g*.

Figure 6B:
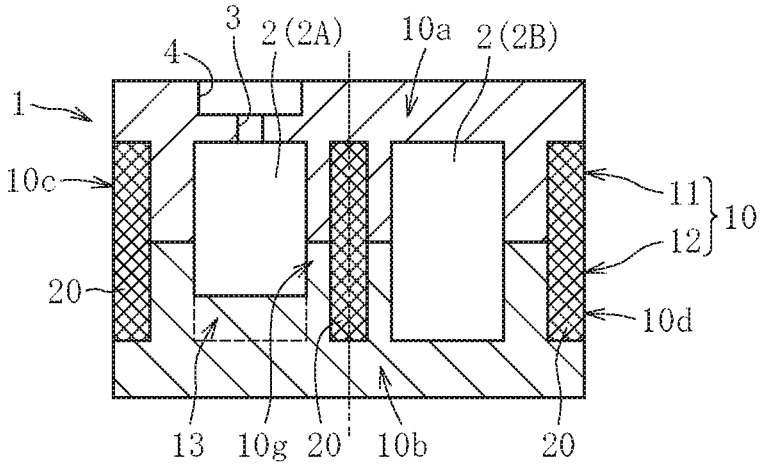
FIG. 6B is a schematic transverse sectional view of a waveguide tube slot antenna according to a fifth embodiment of the first aspect of the present invention.

FIG. 6B is a schematic transverse sectional view of the waveguide tube slot antenna 1 according to a fifth embodiment of the first aspect of the present invention. The waveguide tube slot antenna 1 illustrated in FIG. 6B is a modification example of the waveguide tube slot antenna 1 illustrated in FIG. 5A to FIG. 5C, and one surface of the metal core 20 held by the side wall 10C and one surface of the metal core 20 held by the side wall 10*d* are exposed on the outer side surface of the waveguide tube 10. Although the illustration is omitted, a similar configuration may also be adopted in the waveguide tube slot antenna 1 illustrated in each of FIG. 2 and FIG. 4.

The waveguide tube slot antenna 1 according to the embodiments of the first aspect of the present invention, which is described above, has the characteristic of being capable of preventing deformation due to a temperature change or other factors as much as possible, as described above. Thus, in particular, among the waveguide tube slot antennas, the first aspect of the present invention is preferably applicable to a waveguide tube slot antenna required to increase in antenna size (increase in dimension in the tube axis direction) in the relationship with a wavelength and configured to transmit and receive radio waves at a low frequency band where deformation due to a temperature change or other factors is liable to occur.

Figure 7A:
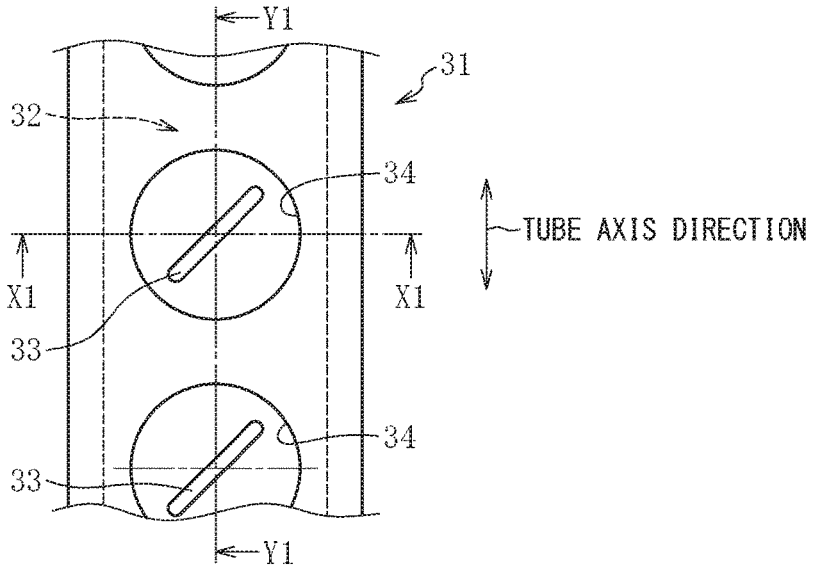
FIG. 7A is a partial schematic plan view of a waveguide tube slot antenna according to a first embodiment of a second aspect of the present invention.
Figure 7B:
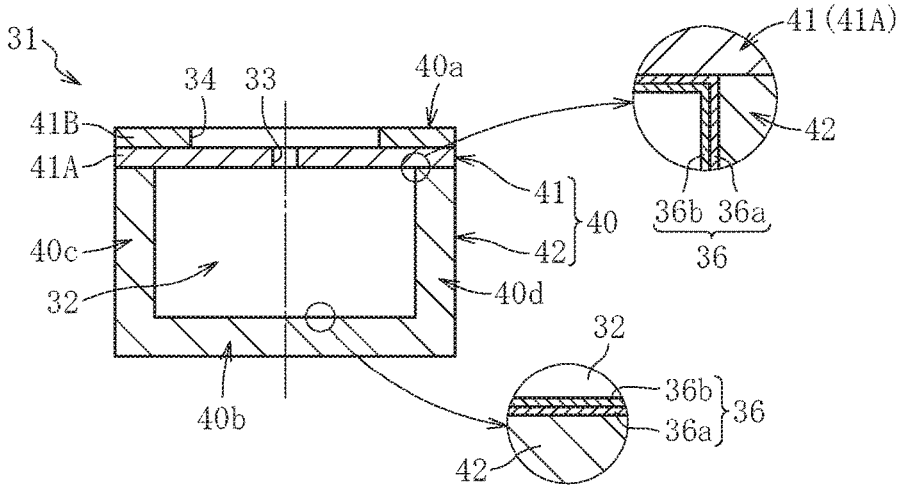
FIG. 7B is a sectional view taken along the line X1-X1 of FIG. 74.
Figure 7C:
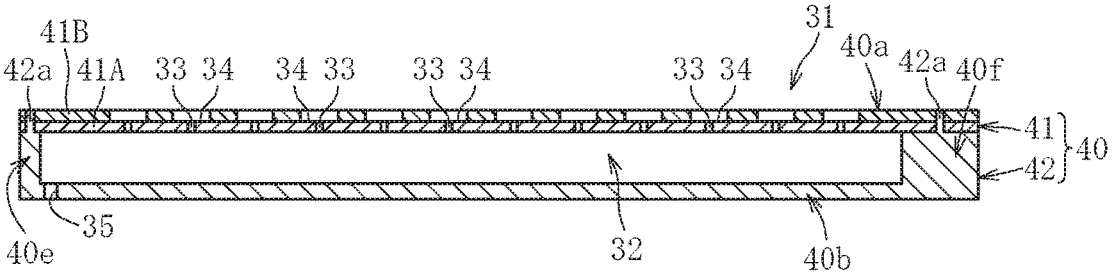
FIG. 7C is a sectional view taken along the line Y1-Y1 of FIG. 7A.

FIG. 7A to FIG. 7C are a partial plan view, a transverse sectional view (a sectional view taken along the line X1-X1 of FIG. 7A), and a longitudinal sectional view (a sectional view taken along the line Y1-Y1 of FIG. 7A) of a waveguide tube slot antenna 31 according to a first embodiment of a second aspect of the present invention, respectively. A waveguide tube slot antenna 31 illustrated in FIG. 7A is used as a member constructing an antenna unit for transmitting and receiving radio waves at a millimeter waveband, for example. Although the illustration is omitted, the above-mentioned antenna unit includes a plurality of (e.g., five) waveguide tube slot antennas 31 connected in series, and a power supply waveguide tube for supplying each waveguide tube slot antenna 31 with high-frequency power (radio waves). When this waveguide tube slot antenna 31 is used in an application for transmitting and receiving radio waves at a millimeter waveband (e.g., 76 GHz band), the size of the waveguide tube slot antenna 31 is set so as to have, for example, a dimension of 90 mm in the tube axis direction (up-and-down direction in the drawing sheet of FIG. 7A), a dimension of 7 mm in the width direction (right-and-left direction in the drawing sheet of FIG. 7A), and a dimension of 7 mm in the height direction (direction orthogonal to the drawing sheet of FIG. 7A).

Next, a detailed structure of the waveguide tube slot antenna 31 is described. As illustrated in FIG. 7A to FIG. 7C, the waveguide tube slot antenna 31 comprises a wave guide tube 40, a plurality of radiating slots 33, and a power supply slot 35. The waveguide tube 40 includes a waveguide 32 inside, Which extends in the tube axis direction. The plurality of radiating slots 33 are provided at predetermined intervals along the tube axis direction of the waveguide tube 40. The power supply slot 35 is provided at one end of the waveguide tube 40 in the tube axis direction and is configured to supply high-frequency power (radio waves) to the waveguide 32. As illustrated in FIG. 7A, the radiating slot 33 in this embodiment is provided such that a straight line extending through a center thereof in the width direction is inclined with respect to the tube axis direction by 45 degrees, but the inclination angle of the radiating slot 33 with respect to the tube axis direction can be appropriately set in accordance with the application or the like.

As illustrated in FIG. 7B and FIG. 7C, the waveguide tube 40 is a rectangular waveguide tube having a transverse section having a rectangular shape at each part in the extending direction of the waveguide 32. More specifically, the waveguide tube 40 comprises a top wall 40*a* and a bottom wall 40*b* which are parallel to each other, and side walls 40*c* and 40*d* which are parallel to each other, and further comprises termination walls 40*e* and 40*f* which close openings on one end and another end in the tube axis direction. The plurality of radiating slots 33 are provided on the top wall 40*a*, and the power supply slot 35 is provided on the bottom wall 40*b*. In this embodiment, the dimension of each of the top wall 30*a* and the bottom wall 30*b* in transverse section is longer than the dimension of each of the side walls 30*c* and 30*d* in transverse section. In the following, the side on which the top wall 40*a* is provided is referred to as the upper side, and the side on which the bottom wall 40*b* is provided is referred to as the lower side for convenience of description. However, this does not limit the usage form of the waveguide tube slot antenna 31.

The top wall 40*a* has a hole 34 which is provided on a front side in a radiation direction of radio waves radiated to the outside through the radiating slot 33, and on the inner periphery of which the radiating slot 33 is disposed. That is, a plurality of opened holes 34 are provided along the tube axis direction on the outer surface (top surface) of the top wall 40*a*, and one radiating slot 33 is opened in the inner bottom surface of each hole 34. In this embodiment, the hole 34 is formed so as to have a perfect circle shape in plan view, but the hole 34 may be formed so as to have a rectangular shape, an ellipse shape, or the like in plan view. Through formation of such a hole 34, it is possible to suppress extraneous emission referred to also as grating lobes, thereby being capable of enhancing the antenna characteristics.

The waveguide tube 40 includes a coupled body of first and second waveguide tube forming members 41 and 42 whose transverse sections in each part of the waveguide 32 in the extending direction thereof each have a shape with an ends. Specifically, as illustrated in FIG. 7B and FIG. 7C, the waveguide tube 40 includes a coupled body of the first waveguide tube forming member 41 constructing the top wall 40*a* and the second waveguide tube forming member 42 integrally having the bottom wall 40*b*, the side walls 40*c* and 40*d*, and the termination walls 40*e* and 40*f*, that is, a coupled body of the first waveguide tube forming member 41 having a flat shape and the second waveguide tube forming member 42 having a recessed shape with an opened upper side in the transverse section.

The first waveguide tube forming member 41 includes, for example, a laminate of a first metal plate 41A formed into a predetermined shape by performing pressing (punching) on the metal plate and a second metal plate 41B formed into a predetermined shape by performing pressing (punching) on the metal plate. The radiating slot 33 is formed simultaneously with formation of the first metal plate 41A by pressing, and the hole 34 is formed simultaneously with formation of the second metal plate 41B by pressing.

Meanwhile, the second waveguide tube forming member 42 is a resin member integrally holding the first waveguide tube forming member 41, that is, an injection-molded article of a resin obtained by insertion of the first waveguide tube forming member 41 and injection molding with resin, and the power supply slot 35 is molded simultaneously with the injection-molding. As a resin material for use in molding of the second waveguide tube forming member 42, for example, there is used a material obtained by taking as a base resin at least one kind of thermoplastic resin selected from the group consisting of a liquid crystal polymer (LCP), a polyphenylene sulfide (PPS), and a polyacetal (POM), and adding one or a plurality of fillers such as glass fibers (GF) and carbon fibers (CF) to the base resin as necessary. Among the base resins exemplified above, the LCP is preferred because the LCP is excellent in form stability compared to a PPS or the like and may preferably suppress an occurrence amount of burrs caused by the molding.

Figure 8A:
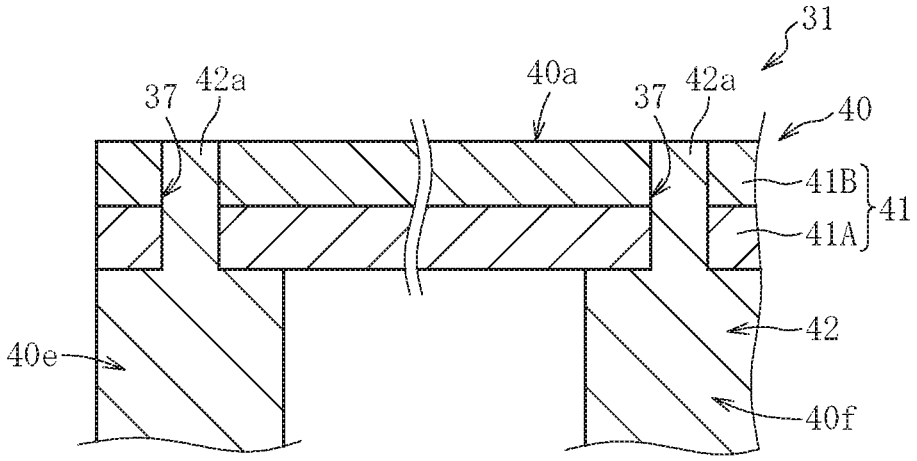
FIG. 8A is a partial enlarged sectional view of the waveguide tube slot antenna illustrated in FIG. 7.

As illustrated in an enlarged manner in FIG. 8A, the second waveguide tube forming member 42 includes a holder 42*a* integrally holding the first waveguide tube forming member 41. This holder 42*a* is obtained by disposing the two metal plates 41A and 41B in a laminate state as an insertion component in a molding die, and then filling a filling part (hole) 37, which is provided in each of the two metal plates 41A and 41B, with the above-mentioned resin material to injection-mold the second waveguide tube forming member 42. In this embodiment, as illustrated in FIG. 7C, the holder 42*a* is provided only in each of the ends in the tube axis direction (termination walls 40*e* and 40*f*). However, as a matter of course, the holder 42*a* can be provided on each of the side walls 40*c* and 40*d*.

Figure 8B:
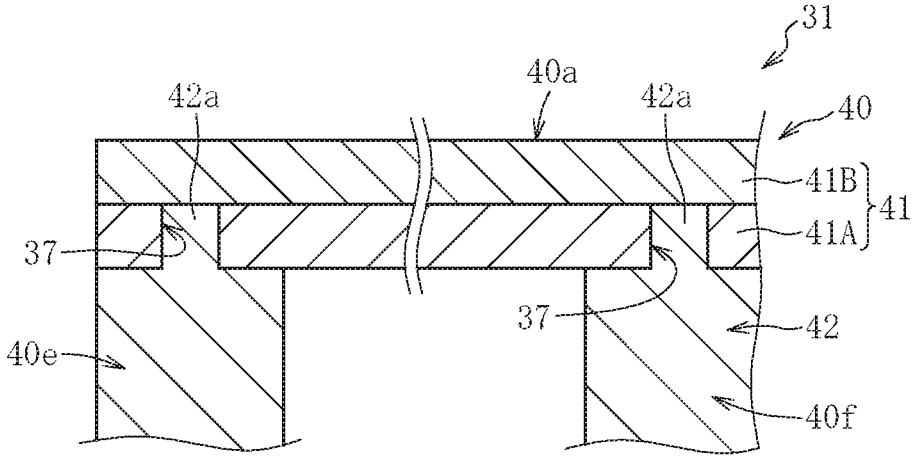
FIG. 8B is a partial enlarged sectional view of a waveguide tube slot antenna according to a modification example.

The above-mentioned holder 42*a* can also be obtained by a method other than the above-mentioned method, for example, a method of coupling and integrating the two metal plates 41A and 41B by appropriate means such as adhesion or welding, disposing this integrated article (first waveguide tube forming member 41) as an insertion component in a molding die, and then filling a plurality of filling parts 37 provided only in the first metal plate 41A with the above-mentioned resin material, to injection-mold the second waveguide tube forming member 42 (see FIG. 8B). The configuration illustrated in FIG. 8B is preferably obtained as described above from the viewpoint of preventing the deformation of the second waveguide tube forming member 42 due to the molding shrinkage thereof, but the configuration can also be obtained such that the second waveguide tube forming member 42 is injection-molded with resin by taking only the first metal plate 41A as an insertion component and the second metal plate 41B is then coupled to the first metal plate 41A by appropriate means.

In the waveguide tube 40, at least the defining surface of the waveguide 32 is coated with a conductive coating film 36 as illustrated in an enlarged view of FIG. 7B. The conductive coating film 36 is not interrupted even in an abutting part (boundary part) of the two waveguide tube forming members 41 and 42, and continues on the surface of the first waveguide tube forming member 41 which defines the waveguide 32 and the surface of the second waveguide tube forming member 42 which defines the waveguide 32. The conductive coating film 36 as described above is obtained by obtaining the waveguide tube 40 in such a manner as described above and then performing the processing for forming the conductive coating film 36, specifically, electroless plating processing, on the waveguide tube 40. Although the illustration is omitted, the conductive coating film 36 may be formed on the outer surface of the waveguide tube 40 (the entire surface of the waveguide tube 40) in addition to the surface defining the waveguide 32. Such a configuration can be obtained by performing the processing for forming the conductive coating film 36 on the waveguide tube 40 without performing masking processing on the waveguide tube 40. In this case, the masking processing on the waveguide tube 40 can be omitted, which is advantageous in reducing the cost required for formation of the conductive coating film 36, and further, the manufacturing cost of the waveguide tube slot antenna 31.

The conductive coating film 36 may be formed of a single-layer metal plated coating film, but in this embodiment, the conductive coating film 36 is formed of a first coating film 36*a* obtained by precipitation formation on the waveguide tube 40 and a second coating film 36*b* obtained by precipitation formation on the first coating film 36*a*. The first coating film 36*a* can be a plated coating film of a metal that is particularly excellent in conductivity (propagation property of the radio wave) such as copper, silver, or gold. Further, the second coating film 36*b* can be a plated coating film of a metal that is excellent in resistance (corrosion resistance) such as nickel. With the conductive coating film 36 having such a stacked structure, the conductive coating film 36 can have high conductivity and high resistance simultaneously, and in addition, a usage amount of an expensive metal such as copper and silver can be suppressed to suppress the increase in cost.

The conductive coating film 36 is poor in durability when the film thickness thereof is excessively small, and on the contrary, when the film thickness is excessively large, it takes a great deal of time to form the conductive coating film 36, with the result that the cost increases. From such a viewpoint, it is preferred that the film thickness of the conductive coating film 36 be set to 0.2 μm or more and 1.5 μm or less. When the conductive coating film 36 has a laminate structure of the first coating film 36*a* and the second coating film 36*b* as in the this embodiment, the respective film thicknesses of the first coating film 36*a* and the second coating film 36*b* can be set to from about 0.1 μm to about 1.0 μm and from about 0.1 μm to about 0.5 μm, for example.

In the waveguide tube slot antenna 31 described above, the waveguide tube 40 includes a coupled body of the first waveguide tube forming member 41 formed of a flat metal member having a plurality of radiating slots 33 and the second waveguide tube forming member 42 formed of a resin member integrally holding the first waveguide tube forming member 41, and at least the defining surface of the waveguide 32 in the waveguide tube 40 is coated with the continuous conductive coating film 36. As described above, the waveguide tube slot antenna 31 having such a configuration can be manufactured by inserting the first waveguide tube forming member 41 formed of the flat metal member to injection-mold the second waveguide tube forming member 42 with resin so as to obtain the waveguide tube 40, and then performing the processing for forming the conductive coating film 36 on the waveguide tube 40.

As described above, through insertion of the first waveguide tube forming member 41 made of metal to injection-mold the second waveguide tube forming member 42 with resin so as to obtain the waveguide tube 40, the first waveguide tube forming member 41 can function as a reinforcing member, so that the waveguide tube 40 which is less liable to be deformed due to a temperature change or other factors can be obtained at low cost while the deformation of the second waveguide tube forming member 42 due to the molding shrinkage thereof is prevented as much as possible.

Further, the second waveguide tube forming member 42, which is injection-molded with resin by insertion of the first waveguide tube forming member 41, includes the holder 42*a* integrally holding the first waveguide tube forming member 41, and in the waveguide tube 40 formed of the coupled body of the two waveguide tube forming members 41 and 42, at least the defining surface of the waveguide 32 is coated with the continuous conductive coating film (seamless conductive coating film) 36, thereby being capable of effectively preventing formation of such a gap, through which radio waves propagated in the waveguide 32 leak to the outside, in the abutting part of the two waveguide tube forming members 41 and 42. From the above, it is possible to reduce as much as possible the likelihood of occurrence of such failures that cause deterioration in antenna characteristics, the failures being a decrease in propagation efficiency of radio waves caused by decreased shape accuracy of the waveguide tube 40 (waveguide 32), external leakage of radio waves through a gap formed in the abutting part of the two waveguide tube forming members 41 and 42, and some other failures. Thus, it is possible to achieve at low cost the waveguide tube slot antenna 31 capable of stably exerting desired antenna characteristics.

The waveguide tube slot antenna 31 according to the first embodiment of the second aspect of the present invention is described above, but appropriate changes can be made to the waveguide tube slot antenna 31 within a scope that does not depart from the gist of the present invention. Now, other embodiments of the second aspect of the present invention are described with reference to the drawings, but the components equivalent to those of the first embodiment described above are denoted by common reference symbols, and duplicate descriptions thereof are omitted.

Figure 9A:
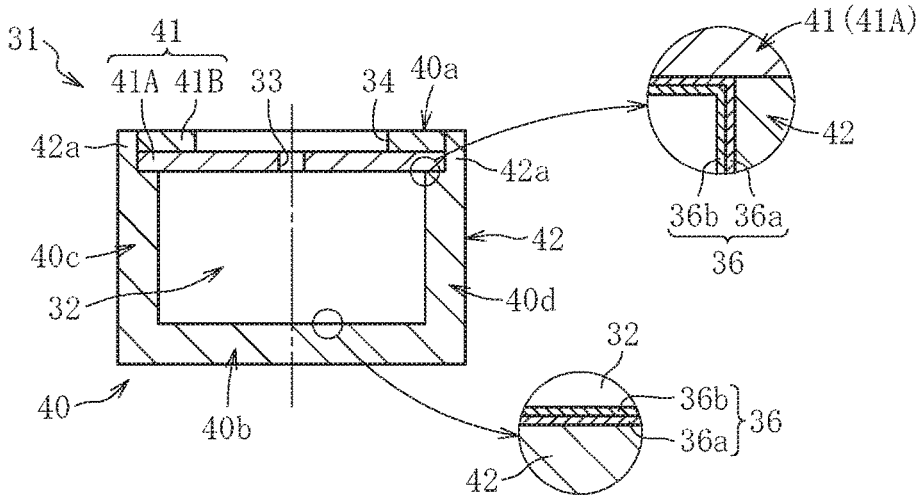
FIG. 9A is a transverse sectional view of a waveguide tube slot antenna according to a second embodiment of the second aspect of the present invention.
Figure 9B:
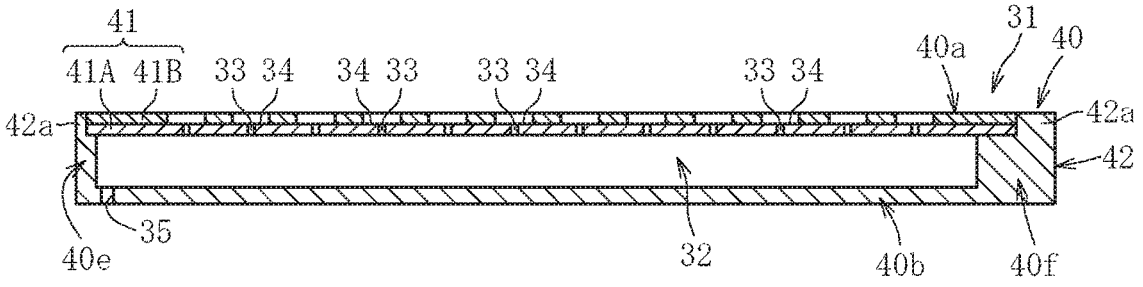
FIG. 9B is a longitudinal sectional view of the antenna.

FIG. 9A and FIG. 9B are a conceptual transverse sectional view and a conceptual longitudinal sectional view of the waveguide tube slot antenna 31 according to a second embodiment of the second aspect of the present invention, respectively. The waveguide tube slot antenna 31 illustrated in each of these drawings is different from the waveguide tube slot antenna 31 described above mainly in that the holder 42*a* integrally holding the first waveguide tube forming member 41 is formed endlessly along the upper-end outer periphery of the second waveguide tube forming member 42, namely, the upper-end outer periphery of each of the side walls 40*c* and 40*d*, and the termination walls 40*e* and 40*f* Even with such a configuration adopted, it is possible to obtain a similar action and effect to that of the waveguide tube slot antenna 31 according to the first embodiment.

Figure 10A:
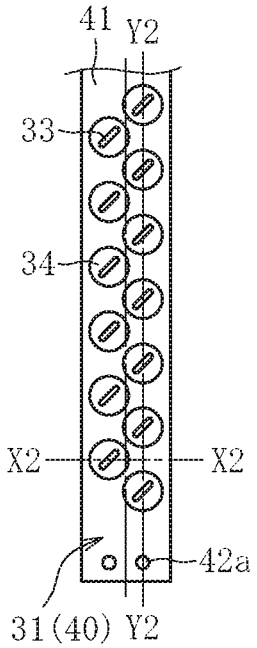
FIG. 10A is a partial schematic plan view of a waveguide tube slot antenna according to a third embodiment of the second aspect of the present invention.
Figure 10B:
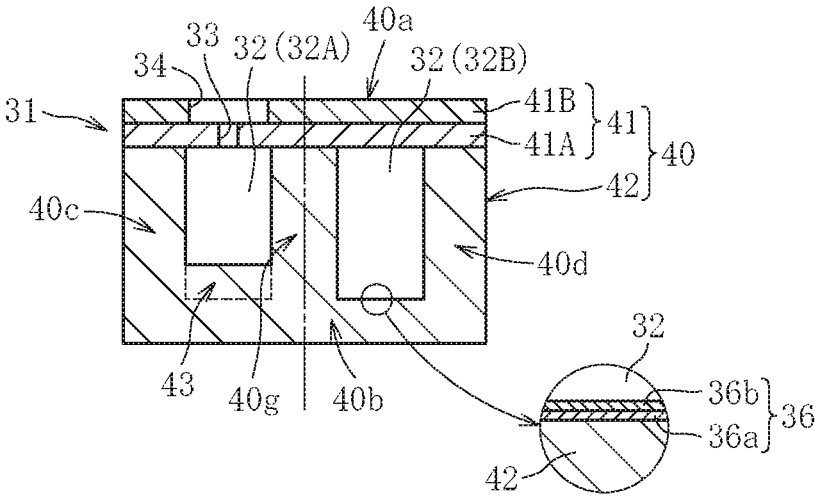
FIG. 10B is a sectional view taken along the line X2-X2 of FIG. 10A.
Figure 10C:
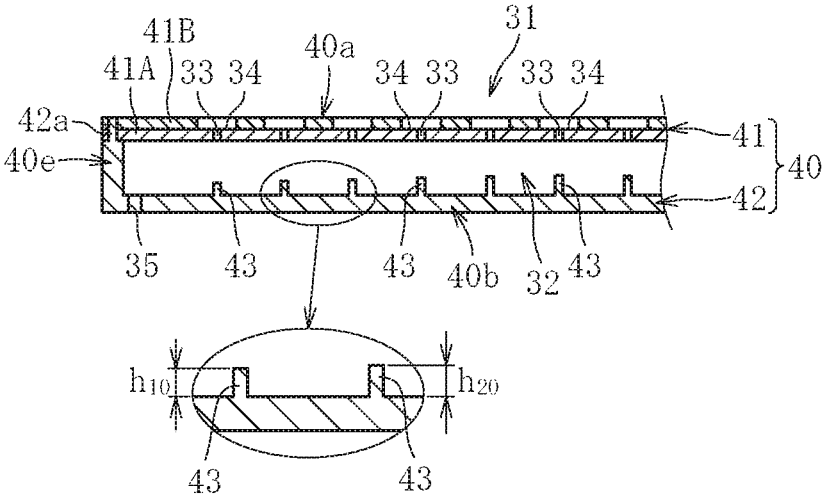
FIG. 10C is a sectional view taken along the line Y2-Y2 of FIG. 10A.

FIG. 10A to FIG. 10C are a partial schematic plan view, a transverse sectional view (a sectional view taken along the line X2-X2 of FIG. 10A), and a longitudinal sectional view (a sectional view taken along the line Y2-Y2 of FIG. 10A) of the waveguide tube slot antenna 31 according to a third embodiment of the second aspect of the present invention, respectively. In the waveguide tube slot antenna 31 according to this embodiment, as illustrated in FIG. 10A, two radiating slot rows each obtained by arranging the plurality of radiating slots 33 along the tube axis direction at predetermined intervals are provided in the width direction of the waveguide tube 40, and at the same time, the radiating slot 33 forming one of the radiating slot rows and the radiating slot 33 forming the other radiating slot row are located in mutually different positions in the tube axis direction. To briefly describe, in the waveguide tube slot antenna 31 according to this embodiment, the plurality of radiating slots 33 and recess parts 34 are arranged in a staggered shape.

Further, as illustrated in FIG. 10B and FIG. 10C, the waveguide tube slot antenna 31 (waveguide tube 40) of the third embodiment further includes a branching wall 40*g* and a plurality of inner walls 43. The branching wall 40*g* is disposed parallel to the side walls 40*c* and 40*d*, and divides the waveguide 32 into two waveguides 32A and 32B. The plurality of inner walls 43 reduce the cross sectional area of the waveguide 32 (32A and 32B) in formation positions for the radiating slots 33. The inner wall 43 is erected on the inner bottom surface of the bottom wall 40*b*, and is formed so as to satisfy a relational expression of $h_{10} \leq h_{20}$, where, of two inner walls 43 and 43 adjacent in the tube axis direction, $h_{10}$ represents the height dimension of the inner wall 43 on a side relatively close to the power supply slot 35, and $h_{20}$ represents the height dimension of the inner wall 43 on a side relatively far from the power supply slot 35 (see an enlarge view in FIG. 10C). One radiating slot array is formed along the waveguide 32A, and another radiating slot array is formed along the waveguide 32B.

As described above, when the inner wall 43 for reducing the cross sectional area of the waveguide 32 is provided in the formation position for the radiating slot 33 in advance, it is possible to enhance the radiation efficiency of radio waves propagated in the waveguide 32. In particular, assuming that, of two inner walls 43 and 43 adjacent in the tube axis direction, $h_{10}$ represents the height dimension of the inner wall 43 on a side relatively close to the power supply slot 35, and $h_{20}$ represents the height dimension of the inner wall 43 on a side relatively far from the power supply slot 35, when the relational expression of $h_{10} \leq h_{20}$ is satisfied, the amount of radio waves radiated to the outside through each radiating slot 33 is less liable to vary among the radiating slots 33, so that almost an equal amount of radio waves can be radiated from each radiating slot 33. Thus, it is possible to avoid as much as possible the occurrence of variations in antenna performance among the parts in the tube axis direction and achieve the waveguide tube slot antenna 31 having excellent reliability.

The waveguide tube 40 constructing the waveguide tube slot antenna 31 of this embodiment also includes the first waveguide tube forming member 41 formed of a flat metal member and the second waveguide tube forming member 42 made of a resin, which integrally holds the first waveguide tube forming member 41 (injection-molded by inserting the first waveguide tube forming member 41), and at least a defining surface of the waveguide 32 is coated with the continuous conductive coating film 36.

Figure 11:
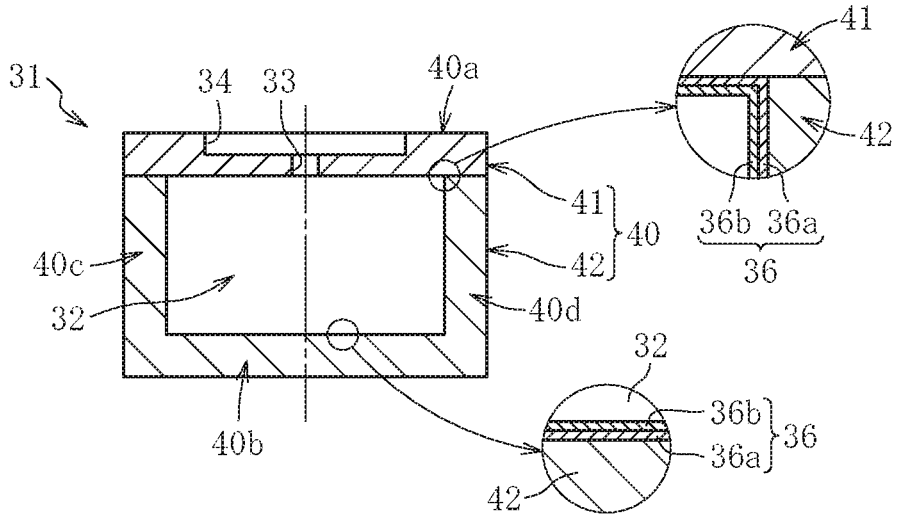
FIG. 11 is a modification example of FIG. 7 and is a transverse sectional view of a waveguide tube slot antenna according to a fourth embodiment of the second aspect of the present invention.

FIG. 11 is a schematic transverse sectional view of the waveguide tube slot antenna 31 according to a fourth embodiment of the second aspect of the present invention. The waveguide tube slot antenna 31 illustrated in this drawing is a modification example of the waveguide tube slot antenna 31 illustrated in FIG. 7A to FIG. 7C and has a different configuration from that of the waveguide tube slot antenna 31 illustrated in FIG. 7A or other drawings in that the first waveguide tube forming member 41 is formed of a single flat metal member. Although the illustration is omitted, as a matter of course, the configuration of the fourth embodiment can be applied to the waveguide tube slot antenna 31 illustrated in each of FIG. 9A, FIG. 10A, or other drawings.

As a matter of course, the second aspect of the present invention described above can be applied to a waveguide tube slot antenna for transmitting and receiving radio waves at a centimeter waveband (low-frequency band), other than being applied to the waveguide tube slot antenna 31 for transmitting and receiving radio waves at a millimeter waveband (high-frequency band).

The above-mentioned first and second aspects of the present invention are by no means limited to the embodiments described above. As a matter of course, those aspects of the present invention may be carried out in further various modes without departing from the spirit of this invention.

REFERENCE SINGS LIST

1 waveguide tube slot antenna
2 waveguide
3 radiating slot
5 power supply slot
10 waveguide tube
11 first waveguide tube forming member
12 second waveguide tube forming member
20 metal core
20A first metal core
20B second metal core

31 waveguide tube slot antenna
32 waveguide
33 radiating slot
34 hole
35 power supply slot
36 conductive coating film
40 waveguide tube
41 first waveguide tube forming member
41A first metal plate
41B second metal plate
42 second waveguide tube forming member
42*a* holder

The invention claimed is:

1. A waveguide tube slot antenna, comprising:

a waveguide tube that is made of a resin and includes a waveguide extending in a tube axis direction, with a defining surface of the waveguide coated with a conductive coating film; and a plurality of radiating slots provided at predetermined intervals along the tube axis direction of the waveguide tube, the waveguide tube including a first waveguide tube forming member and a second waveguide tube forming member each having a transverse section having a shape with an end at each part in an extending direction of the waveguide, and being configured to define the waveguide by being coupled to each other, the waveguide tube slot antenna including a metal core disposed along the tube axis direction, and the metal core being held by both the first waveguide tube forming member and the second waveguide tube forming member.

2. The waveguide tube slot antenna according to claim 1, wherein at least one of the first waveguide tube forming member and the second waveguide tube forming member is an injection-molded article of a resin integrally including the metal core.

3. The waveguide tube slot antenna according to claim 1, wherein the metal core includes a coupled body of a first metal core and a second metal core, and wherein the first waveguide tube forming member is an injection-molded article of a resin integrally including the first metal core, and the second waveguide tube forming member is an injection-molded article of a resin integrally including the second metal core.

4. The waveguide tube slot antenna according to claim 1, wherein the metal core is partially exposed to an outer surface of the waveguide tube.

5. The waveguide tube slot antenna according to claim 1, wherein both the first waveguide tube forming member and the second waveguide tube forming member have the traverse section having a recessed shape.

6. A waveguide tube slot antenna, comprising:

a waveguide tube that includes a waveguide extending in a tube axis direction; and a plurality of radiating slots provided at predetermined intervals along the tube axis direction of the waveguide tube, the waveguide tube including a coupled body of a first waveguide tube forming member and a second waveguide tube forming member each having a shape with an end at each part in an extending direction of the waveguide, the first waveguide tube forming member being formed of a flat metal member having the plurality of radiating slots, the second waveguide tube forming member being formed of a resin member integrally holding the first waveguide tube forming member, and at least a defining surface of the waveguide in the waveguide tube being coated with a continuous conductive coating film.

7. The waveguide tube slot antenna according to claim 6, wherein the first waveguide tube forming member further has a hole, which is provided on a front side in a radiation direction of radio waves radiated to an outside through the radiating slot, and on an inner periphery of which the radiating slot is disposed.

8. The waveguide tube slot antenna according to claim 7, wherein the first waveguide tube forming member is a laminate of a first metal plate having the radiating slot and a second metal plate having the hole.

9. The waveguide tube slot antenna according to claim 6, wherein the conductive coating film is formed seamlessly on the entire outer surface of the waveguide tube.

10. A method of manufacturing a waveguide tube slot antenna that includes:

a waveguide tube that includes a waveguide extending in a tube axis direction; and a plurality of radiating slots provided at predetermined intervals along the tube axis direction of the waveguide tube, the waveguide tube including a coupled body of a first waveguide tube forming member and a second waveguide tube forming member each having a transverse section having a shape with an end at each part in an extending direction of the waveguide, the method comprising:

inserting the first waveguide tube forming member formed of a flat metal member having the plurality of radiating slots to injection-mold the second waveguide tube forming member with resin so as to obtain the waveguide tube; and performing a processing for forming a conductive coating film on the waveguide tube, the conductive coating film being configured to coat at least a defining surface of the waveguide.

11. The method of manufacturing the waveguide tube slot antenna according to claim 10, wherein the processing for forming the conductive coating film is performed on the waveguide tube without performing masking processing on the waveguide tube.

* * * * *